US008887442B2

(12) United States Patent
Aragon et al.

(10) Patent No.: US 8,887,442 B2
(45) Date of Patent: Nov. 18, 2014

(54) SYSTEM FOR ALLOWING A LOADING DOCK DOOR TO RELEASE FROM A TRACK

(71) Applicant: Cold Chain, LLC, Boise, ID (US)

(72) Inventors: Daniel M. Aragon, Meridian, ID (US); Peter James Wachtell, Boise, ID (US); Todd J. Lindsey, Boise, ID (US); John J. Prehn, Boise, ID (US)

(73) Assignee: Cold Chain, LLC, Boise, ID (US)

( * ) Notice: Subject to any disclaimer, the term of this patent is extended or adjusted under 35 U.S.C. 154(b) by 0 days.

(21) Appl. No.: 14/041,470

(22) Filed: Sep. 30, 2013

(65) Prior Publication Data

US 2014/0096451 A1 Apr. 10, 2014

Related U.S. Application Data

(60) Provisional application No. 61/709,401, filed on Oct. 4, 2012.

(51) Int. Cl.
*E05B 65/10* (2006.01)

(52) U.S. Cl.
USPC ..... 49/141; 49/197; 160/201

(58) Field of Classification Search
USPC ..... 49/141, 197, 198; 160/201, 205, 282, 160/285, 284, 287
See application file for complete search history.

(56) References Cited

U.S. PATENT DOCUMENTS

| | | | | |
|---|---|---|---|---|
| 5,535,805 | A * | 7/1996 | Kellogg et al. | 160/201 |
| 5,927,368 | A * | 7/1999 | Rohrer et al. | 160/201 |
| 6,119,307 | A * | 9/2000 | Weishar et al. | 16/87 R |
| 6,273,175 | B1 * | 8/2001 | Kellogg et al. | 160/205 |
| 7,757,437 | B2 * | 7/2010 | Schulte et al. | 49/141 |
| 2001/0027847 | A1 * | 10/2001 | Horner et al. | 160/205 |
| 2002/0179254 | A1 * | 12/2002 | Schulte | 160/201 |
| 2003/0178159 | A1 * | 9/2003 | David | 160/201 |
| 2011/0088327 | A1 * | 4/2011 | Meichtry | 49/197 |

* cited by examiner

*Primary Examiner* — Gregory J. Strimbu
(74) *Attorney, Agent, or Firm* — MH2 Technology Law Group, LLP

(57) ABSTRACT

A system for allowing a loading dock door to release from guide tracks. The dock door includes wheel-and-axle assemblies which are mounted to the door and which include wheels biased towards a position in the tracks. At least one of the tracks has a cross sectional profile which enables the wheels disposed in the one of the tracks to move out of the one of the tracks when the door is struck with sufficient force.

14 Claims, 4 Drawing Sheets

SYSTEM FOR ALLOWING A LOADING DOCK DOOR TO RELEASE FROM A TRACK

RELATED APPLICATION

This non-provisional application claims benefit to U.S. Provisional Application No. 61/709,401, filed Oct. 4, 2012, the disclosure of which is hereby incorporated by reference in its entirety.

FIELD OF THE DISCLOSURE

This disclosure relates generally to the field of dock doors and more specifically to a system for allowing a loading dock door to be mounted and used with the functionality such that, upon being struck by a fork lift or other strong force it releases itself from its tracks.

BACKGROUND

Warehouse operations generally have several door openings from which truck or rail cargos may be easily loaded and unloaded. These door openings are generally covered when not in use by doors that are specifically designed to be used as loading dock doors. The typical loading dock door has aspects of its design that make it suitable for loading dock operations, such as some ability to be locked and to provide security for the premises, a window through which to see if a truck or train is backed into the loading dock area, a wheel and track system that allows the door to be opened, either by lifting or rolling up in a vertical fashion, so that when opened it is out of the way of any traffic that results from the loading process.

Loading dock doors often sustain damage as large and heavy loads are moved at frequent high speeds by forklift operators through and around the openings on loading docks. A door that has been struck may be damaged and may, in some cases, not be easily or smoothly opened until it has been repaired and/or adjusted to work properly.

To address these issues, most loading dock doors have been designed to withstand a significant amount of abuse. Doors can be built to withstand greater amounts of abuse by using heavier gauge metals and/or braces for reinforcement to withstand greater strikes from forklifts. As these doors are built to be stronger, they also become heavier and more costly.

In some cases, the doors are designed to be able to release themselves from their tracks via a pivot system that has been built into the wheel and axle assemblies. Door systems that are designed to break away from their tracks have involved the creation of designed pivot points on the wheel assemblies or wheel axles. These break-away points allow the door to break away from the tracks and to be remounted with relative ease and a minimum amount of door damage. Unfortunately, the wheel assemblies are complicated, expensive and prone to breakage with continued use.

SUMMARY

Embodiments of the present disclosure may provide one or more of the following advantages: allowing a door to self-release from its tracks when struck by a fork lift or other relatively large force; reducing damage to a door that has been struck; or allowing the door to be quickly and/or easily reset into its tracks for continued use after self-release.

An embodiment of the present disclosure is directed to a dock door system. The dock door system comprises: a first track and a second track. The first track comprises (i) a first sidewall comprising a first substantially planar region, (ii) a second sidewall comprising a second substantially planar region and (iii) a third sidewall comprising a third substantially planar region. The third sidewall is positioned between the first sidewall and the second sidewall. The first substantially planar region, the third substantially planar region and the second substantially planar region are consecutive planar regions. A first angle is defined by the first and third substantially planar regions and a second angle is defined by the second and third substantially planar regions. A dock door comprises a first plurality of wheel-and-axle assemblies positioned in the first track and a second plurality of wheel-and-axle assemblies positioned in the second track. Each of the first plurality of wheel-and-axle assemblies comprises a first wheel and a first axle, the first wheel biased to a position on the first axle by a biasing mechanism so as to ride in the first track. The first plurality of wheel-and-axle assemblies is configured to allow each of the first wheels to move out of the first track on the first sidewall if the door is struck with sufficient force. The first angle ranges from about 100° to about 160°. In an embodiment, the second track comprises (i) a fourth sidewall comprising a fourth substantially planar region, (ii) a fifth sidewall comprising a fifth substantially planar region and (iii) a sixth sidewall comprising a sixth substantially planar region. The sixth sidewall is positioned between the fourth sidewall and the fifth sidewall. The fourth substantially planar region, the sixth substantially planar region and the fifth substantially planar region are consecutive planar regions. A third angle is defined by the fourth and sixth substantially planar regions and a fourth angle is defined by the fifth and sixth substantially planar regions. The third angle ranges from about 100° to about 160°.

Another embodiment of the present disclosure is directed to a dock door hardware system. The dock door hardware system comprises: a first track comprising (i) a first sidewall comprising a first substantially planar region, (ii) a second sidewall comprising a second substantially planar region and (iii) a third sidewall comprising a third substantially planar region. The third sidewall is positioned between the first sidewall and the second sidewall. The first substantially planar region, the third substantially planar region and the second substantially planar region are consecutive planar regions. A first angle is defined by the first and third substantially planar regions and a second angle is defined by the second and third substantially planar regions. The wheel-and-axle assembly comprises an axle, an axle bracket attachable to a dock door and having a receptacle for receiving the axle, a wheel positioned on the axle, and a biasing mechanism for applying a force tending to force the wheel away from the axle bracket. The receptacle and axle are configured so as to allow the axle to move back and forth in the receptacle relative to the bracket. The wheel and axle assembly is configured so that the wheel can ride in the track. The first angle ranges from about 100° to about 160°.

Yet another embodiment of the present disclosure is directed to a dock door wheel-and-axle assembly. The wheel-and-axle assembly comprises: an axle; an axle bracket attachable to a dock door and having a receptacle for receiving the axle; a wheel positioned on the axle; and a biasing mechanism for applying a force tending to force the wheel away from the axle bracket. The receptacle and axle are configured so as to allow the axle to move back and forth in the receptacle relative to the bracket.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrates embodiments of the present teachings and together with the description, serve to explain the principles of the present teachings.

Figure 1:
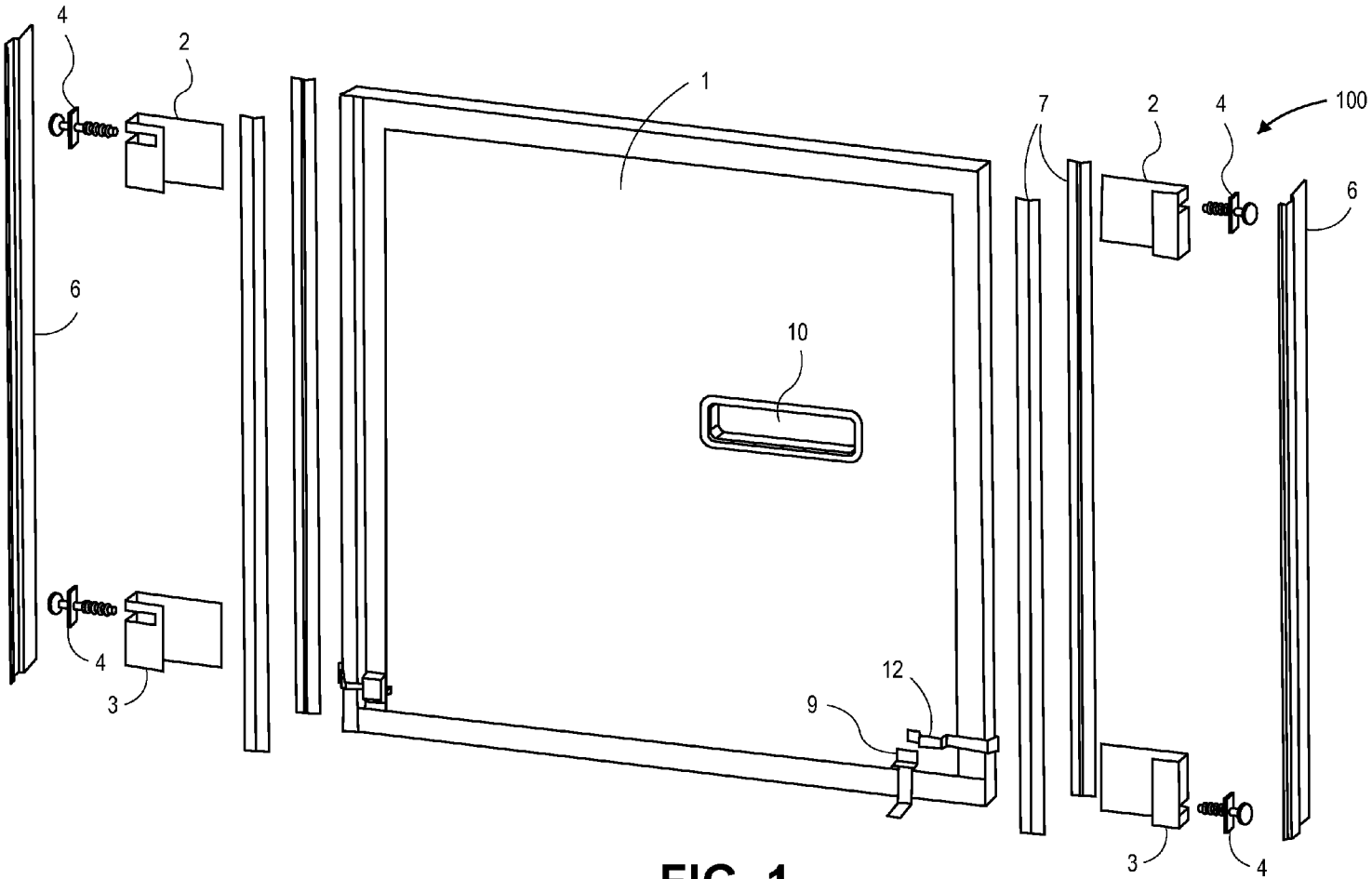
FIG. 1 illustrates a dock door, according to an embodiment of the present disclosure.

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. In the drawings, like reference numerals have been used throughout to designate identical elements. In the following description, reference is made to the accompanying drawings that forms a part thereof, and in which is shown by way of illustration a specific exemplary embodiment in which the present teachings may be practiced. The following description is, therefore, merely exemplary.

In accordance with an embodiment of the disclosure, there is disclosed a loading dock door system that is configured so that in the event it is struck by a fork lift or other strong force, it releases itself from its tracks, thereby reducing the risk of substantial damage to the door. The door system comprises a unique track profile with one or more sidewalls that have an angled sidewall profile to allow the wheel assembly to move up the sidewall and out of the tracks. A tensioned or spring loaded wheel assembly biases the door so that is generally stays on the track, while providing enough flex for the door to ride up the sidewall and out of the tracks when struck with sufficient force.

As will be shown in greater detail below, system comprises a track with an angled sidewall profile combined with wheel assemblies that are spring mounted. The wheel of the wheel assembly can be pushed inward toward the door, allowing the wheel assembly to ride up and out of the track itself, thus releasing the door if it is struck with a force that is large enough to depress the springs in the wheel assembly.

By adjusting the angle of the sidewall in the track and/or the strength of the springs in the assembly, a door can be designed to release easily with relatively modest forces, or to be released only upon relatively large forces striking it. A slight change in the angle of the side wall profile of the track can change the amount of force that is required for a door to be pushed hard enough to be released.

FIG. 1 illustrates a dock door system 100, according to an embodiment of the present disclosure. A dock door 1 includes a plurality of wheel assemblies 4. A track 6 is configured to allow wheels of the wheel assemblies 4 to run in the tracks so that the dock door 1 can be opened and closed, similar to a traditional overhead door. In addition, the track 6 and wheel assemblies 4 are configured so that the wheels can come out of the track 6 when dock door 1 is struck with sufficient force, as will now be described in detail.

Figure 2:
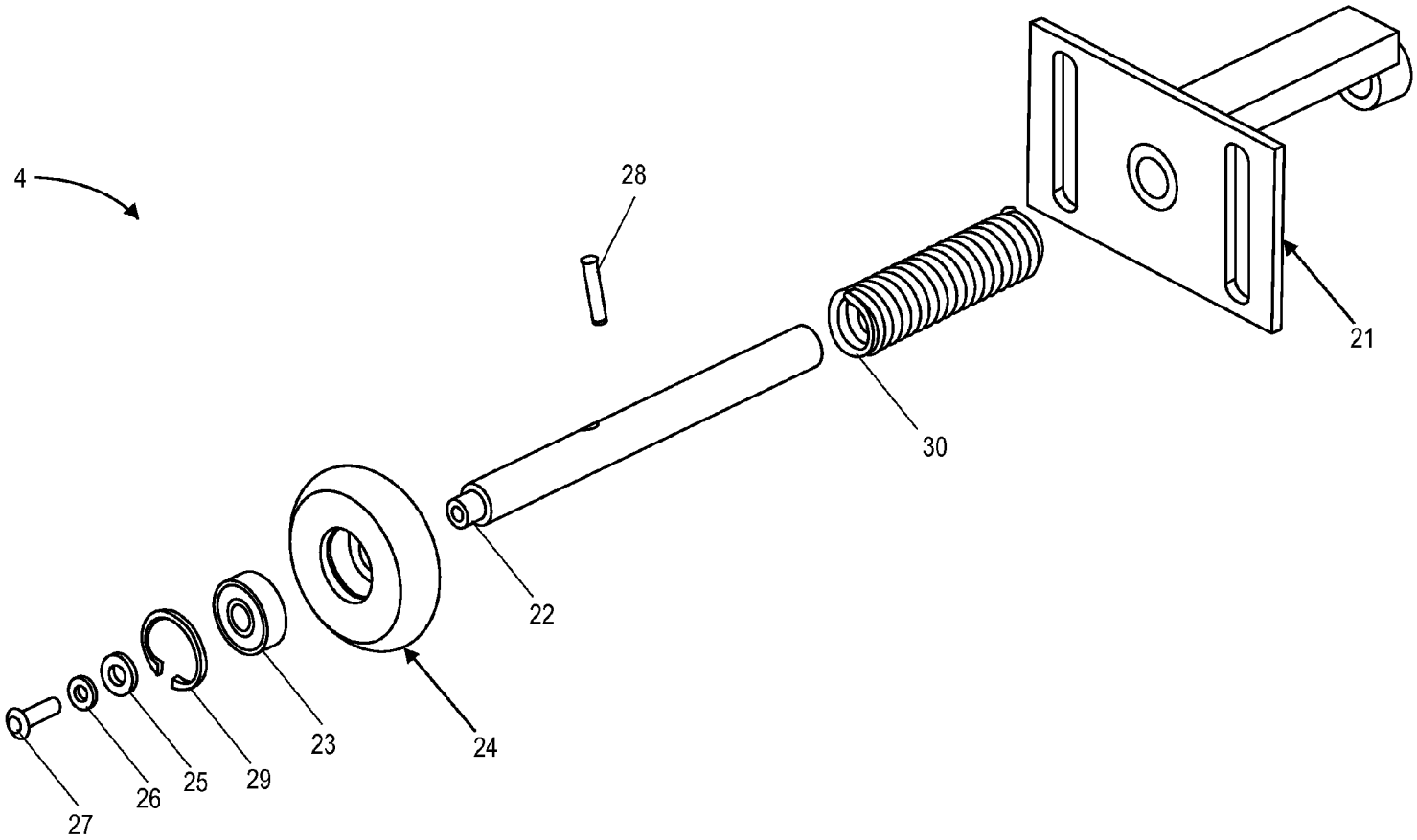
FIG. 2 illustrates an exploded view of a wheel assembly, according to an embodiment of the present disclosure.
Figure 3A:
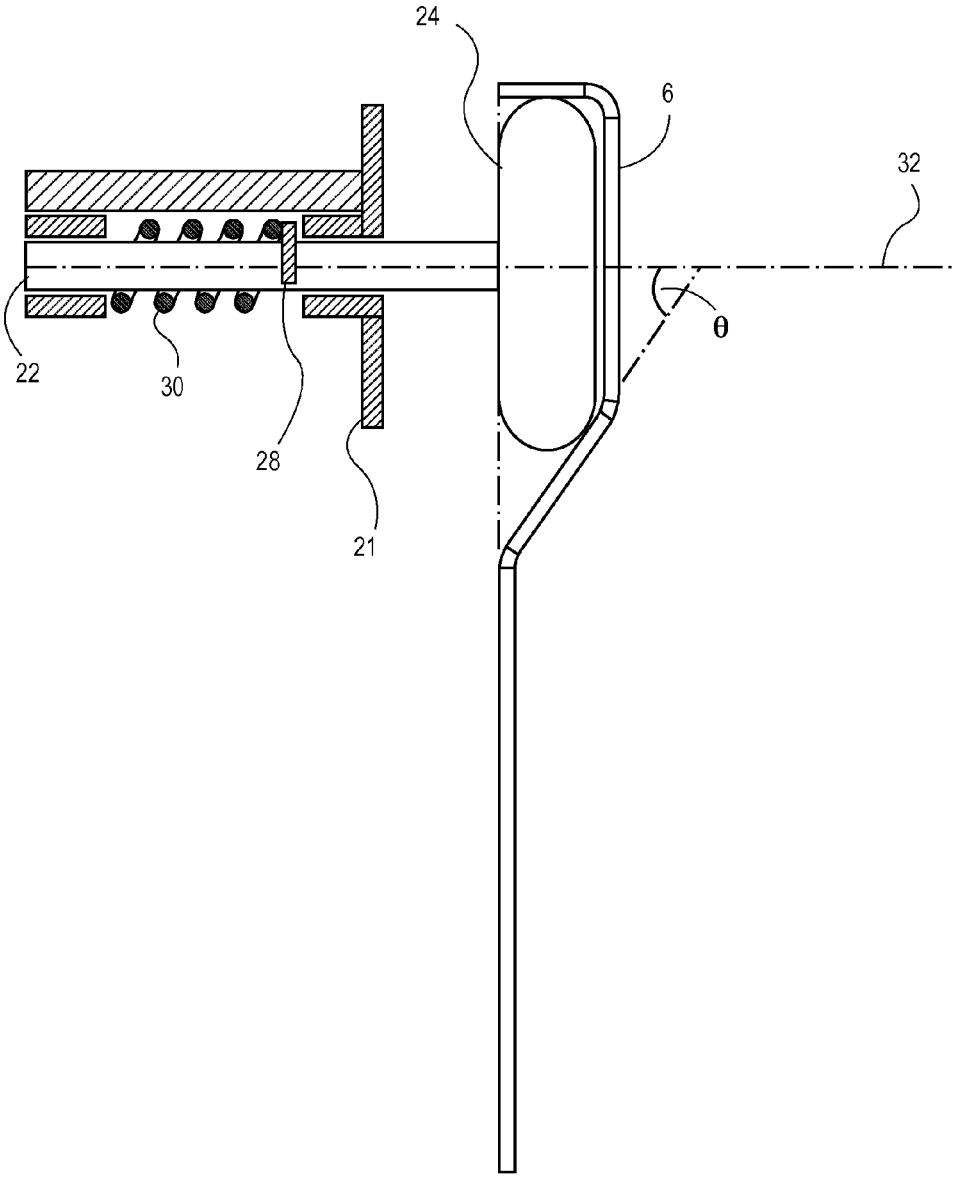
FIG. 3A illustrates a wheel assembly in relation to a dock door and biased in position so as to ride in a track, according to an embodiment of the present disclosure.
Figure 3B:
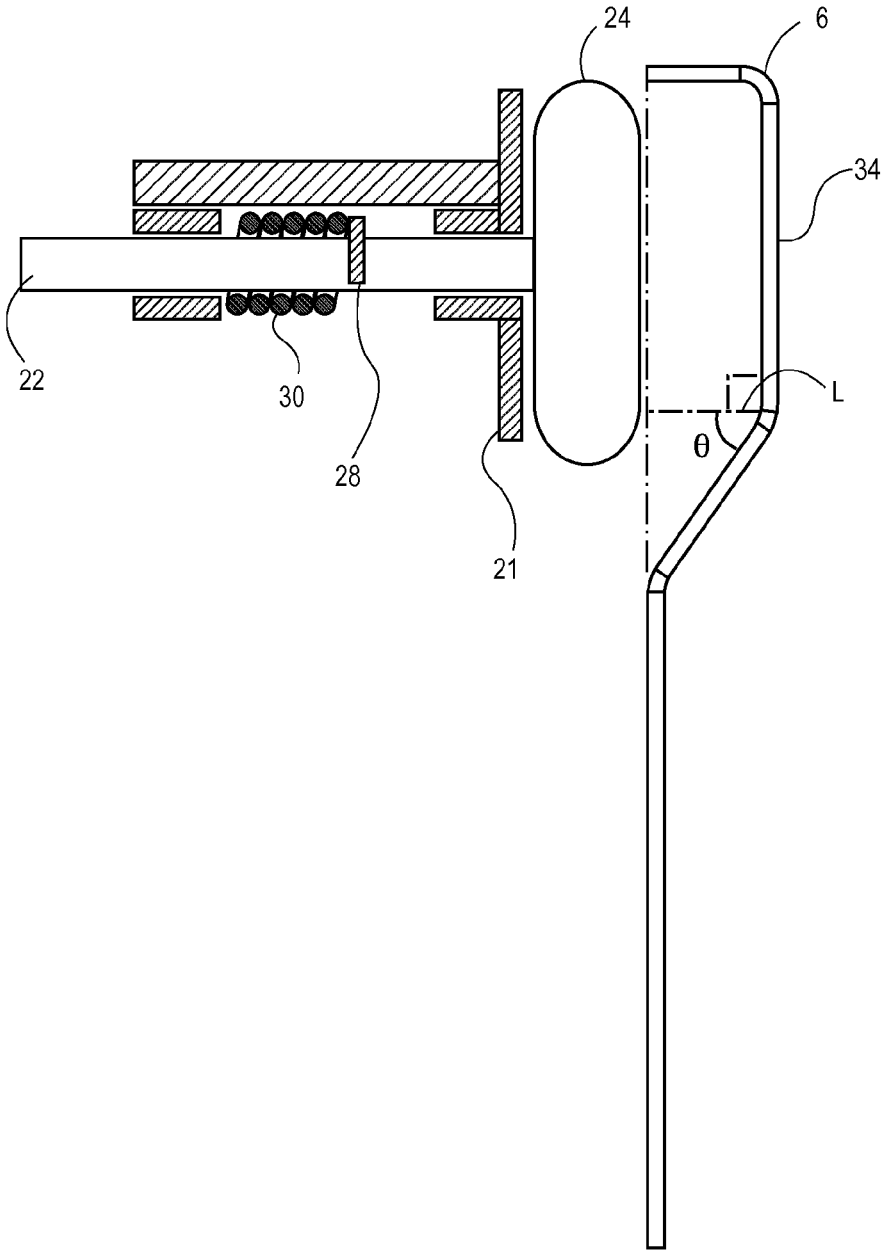
FIG. 3B illustrates a wheel assembly in relation to a dock door and biased in position so as to be out of the track, according to an embodiment of the present disclosure.

FIG. 2 illustrates an exploded view of a wheel assembly 4, according to an embodiment of the present disclosure. Wheel assembly 4 includes a wheel 24, an axle 22, an axle bracket 21 and a biasing mechanism 30. Axle 22 is received by a receptacle in the axle bracket 21, so as to allow the axle 22 to move back and forth in the receptacle relative to the bracket 21. Axle 22 is held in position in track 6 during operation of the dock door 1 by any suitable means, such as a pin 28 and biasing mechanism 30. Biasing mechanism 30 may be, for example, a spring or other tensioning member. In this manner, the wheel 24 is biased in position so as to ride in the track 6, as illustrated in FIG. 3A. The biasing mechanism is configured to also allow the wheel 24 and axle 22 to move relative to the bracket 21, so that the wheel 24 can be positioned out of the track 6, as shown in FIG. 3B.

Wheel bearings 23, washers 25 and 26, bolt 27 and lock ring 29 illustrate an example of an inner wheel assembly. Any other suitable inner wheel assembly can be employed.

Referring again to FIG. 1, a plurality of the wheel assemblies 4 can be attached to one or both sides of dock door 1. The wheel assemblies 4 can be attached to the door using any suitable means, such as brackets 2 and 3.

Track 6 of dock door system 100 includes at least one sidewall having angle, θ, relative to a rotational axis 32 of wheel 24, as more clearly shown in FIG. 3A. In an embodiment, the angle θ, can also be taken as relative to a line, L, normal to a side 34 of the track positioned between the two sidewalls, as shown in FIG. 3B. The one or more sidewalls of track 6 are angled in a manner that allows wheel 24 of wheel assembly 4 to move up the angled sidewall and out of the track 6 when a sufficient force is exerted on the dock door 1 to compress the biasing mechanism 30. For example, θ can range from about 10° to about 70°, such as about 30° to about 60°, or about 40° to about 50°.

In an embodiment, both sidewalls of track 6 can have an angle, θ. In an embodiment, an angled track 6 can be positioned on both sides of dock door 1, where one or both of the track sidewalls are angled. The systems of the present disclosure can offer impact protection on one side and not on the other side, both sides, or in differing amounts for each side of the door based on the angle, θ, that is used for each track. In addition, systems are contemplated that provide protection from impacts on either the inside or outside of the door or both, based on which sidewalls of each track are angled. For example, FIG. 1 shows an inside view of the dock door 1, with the tracks 6 configured so that the sidewalls closest to the outside are angled to provide protection from impacts occurring from inside the building on which the door is hung.

Dock door 1 can be any suitable type of overhead door. In an embodiment, dock door 1 is a rigid insulated door that is designed to maintain a substantially planar shape, similar to that shown in FIG. 1, as it is opened and closed. In an alternative embodiment, dock door 1 can be a roll-up style door. An example of such a door is described in U.S. patent application Ser. No. 13/585,994, filed Aug. 15, 2012, the disclosure of which is hereby incorporated by reference in its entirety.

Dock door 1 can include one or more optional components. Examples of the one or more optional components include weather stripping 7 and/or any other type of seal, a lock 9, a window 10, and a pull-down strap and/or handle 12, or other hardware. Any suitable type of automatic or manual door opening system can be employed to open and close the dock door 1. Such door opening systems are well known in the art.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. A dock door system comprising:

a first track and a second track, the first track comprising (i) a first sidewall comprising a first substantially planar region, (ii) a second sidewall comprising a second substantially planar region and (iii) a third sidewall comprising a third substantially planar region, the third sidewall being positioned between the first sidewall and the second sidewall, the first substantially planar region, the third substantially planar region and the second substantially planar region being consecutive planar regions, a first angle being defined by the first and third substantially planar regions and a second angle being defined by the second and third substantially planar regions; and a dock door comprising a first plurality of wheel-and-axle assemblies and a second plurality of wheel-and-axle assemblies, each of the first plurality of wheel-and-axle assemblies comprising a first wheel positioned on an axle and a biasing mechanism, each of the first wheels positioned on a respective one of the axles biased to a position by a respective one of the biasing mechanisms so as to ride in the first track, the first plurality of wheel-and-axle assemblies being configured to allow the first wheels to move toward the dock door and out of the first track if the door is struck with sufficient force in a direction that pushes the first wheels against the first sidewall, wherein the first angle ranges from about 100° to about 160°.

2. The dock door system of claim 1, wherein each of the first plurality of wheel-and-axle assemblies further comprises:

an axle bracket attached to the dock door and having a receptacle for receiving the axle, the receptacles and axles being configured so as to allow each of the axles to move back and forth in a respective one of the receptacles relative to a respective one of the brackets; and each of the biasing mechanisms applies a force tending to force a respective one of the first wheels away from a respective one of the axle brackets.

3. The dock door system of claim 2, wherein each of the biasing mechanisms is a spring.

4. The dock door system of claim 1, wherein the first angle ranges from about 120° to about 150°.

5. The dock door system of claim 1, wherein the second angle ranges from about 100° to about 160°.

6. The dock door system of claim 1, wherein the biasing mechanisms are springs.

7. The dock door system of claim 1, wherein each of the first plurality of wheel-and-axle assemblies further comprises an axle bracket having a receptacle for receiving the axle and which allows the axle to move back and forth in the receptacle relative to the bracket.

8. The dock door system of claim 7, wherein for each of the first plurality of wheel-and-axle assemblies the axle can move between a first position and a second position in the receptacle, the first wheel of each of the first plurality of wheel-and-axle assemblies being in the first track when the respective one of the axles is in the first position and out of the first track when the respective one of the axles is in the second position.

9. The dock door system of claim 1, wherein the second track is different from the first track, the second track comprising (i) a fourth sidewall comprising a fourth substantially planar region, (ii) a fifth sidewall comprising a fifth substantially planar region and (iii) a sixth sidewall comprising a sixth substantially planar region, the sixth sidewall positioned between the fourth sidewall and the fifth sidewall, the fourth substantially planar region, the sixth substantially planar region and the fifth substantially planar region being consecutive planar regions, a third angle being defined by the fourth and sixth substantially planar regions and a fourth angle being defined by the fifth and sixth substantially planar regions, the third angle ranging from about 100° to about 160°.

10. The dock door system of claim 1, wherein the second track does not comprise a sidewall that allows second wheels of the second plurality of wheel-and-axle assemblies to move out of the second track.

11. A dock door hardware system comprising:

a track comprising (i) a first sidewall comprising a first substantially planar region, (ii) a second sidewall comprising a second substantially planar region and (iii) a third sidewall comprising a third substantially planar region, the third sidewall being positioned between the first sidewall and the second sidewall, the first substantially planar region, the third substantially planar region and the second substantially planar region being consecutive planar regions, a first angle being defined by the first and third substantially planar regions and a second angle being defined by the second and third substantially planar regions; and a wheel-and-axle assembly comprising an axle, an axle bracket attachable to a dock door and having a receptacle for receiving the axle, a wheel positioned on the axle, and a biasing mechanism configured for applying a force tending to force the wheel away from the axle bracket and toward the track so as to ride in the track, the receptacle and axle configured so as to allow the axle to move back and forth in the receptacle relative to the bracket, the wheel-and-axle assembly being configured so that the wheel can move out of the track if a sufficient forced is applied to the wheel-and-axle assembly in a direction that pushes the wheel against the first sidewall, wherein the first angle ranges from about 100° to about 160°.

12. The dock door hardware system of claim 11, wherein the first angle ranges from about 120° to about 150°.

13. The dock door hardware system of claim 11, wherein the second angle ranges from about 100° to about 160°.

14. The dock door hardware system of claim 11, wherein the biasing mechanism is a spring.

* * * * *